US009193023B2

(12) United States Patent
Hong

(10) Patent No.: US 9,193,023 B2
(45) Date of Patent: Nov. 24, 2015

(54) KNIFE SHARPENING SYSTEM

(71) Applicant: Sun-min Hong, Kyeongki-Do (KR)

(72) Inventor: Sun-min Hong, Kyeongki-Do (KR)

( * ) Notice: Subject to any disclaimer, the term of this patent is extended or adjusted under 35 U.S.C. 154(b) by 75 days.

(21) Appl. No.: 14/064,664

(22) Filed: Oct. 28, 2013

(65) Prior Publication Data

US 2014/0051338 A1 Feb. 20, 2014

Related U.S. Application Data

(63) Continuation of application No. PCT/KR2011/006379, filed on Aug. 30, 2011.

(30) Foreign Application Priority Data

May 3, 2011 (KR) ..... 10-2011-0041908

(51) Int. Cl.

| | |
|---|---|
| ***B24B 3/54*** | (2006.01) |
| ***B24B 27/00*** | (2006.01) |
| ***B24B 41/02*** | (2006.01) |
| ***B24B 55/04*** | (2006.01) |

(52) U.S. Cl.

CPC ..... *B24B 27/0007* (2013.01); *B24B 3/54* (2013.01); *B24B 27/0023* (2013.01); *B24B 27/0076* (2013.01); *B24B 41/02* (2013.01); *B24B 55/04* (2013.01)

(58) Field of Classification Search

CPC .. B24B 27/0023; B24B 27/0076; B24B 3/36; B24B 3/54; B24B 41/06; B24B 55/02; B24B 55/04; B24B 55/06; B24B 27/007; B24B 41/02

USPC ..... 451/45, 66, 234, 367, 450, 451, 453, 451/454, 455

See application file for complete search history.

(56) References Cited

U.S. PATENT DOCUMENTS

| | | | | |
|---|---|---|---|---|
| 1,259,494 | A * | 3/1918 | Downer | 451/65 |
| 2,467,674 | A * | 4/1949 | Krueger | 451/213 |

(Continued)

FOREIGN PATENT DOCUMENTS

| | | |
|---|---|---|
| KR | 20-1989-0000997 | 3/1989 |
| KR | 10-0692261 | 3/2007 |

(Continued)

OTHER PUBLICATIONS

International Search Report in counterpart International Application No. PCT/KR2011/006379, mailed May 1, 2012.

*Primary Examiner* — Monica Carter
*Assistant Examiner* — Marcel Dion
(74) *Attorney, Agent, or Firm* — Edell, Shapiro & Finnan LLC

(57) ABSTRACT

A knife sharpening system mountable in a small vehicle is disclosed. The knife sharpening system includes a grinding device including a motor, and an abrasive member directly connected to the motor without using a reduction device, to reduce loss of power transmitted from a battery to the abrasive member, and a water-proof device for preventing scattering of water and dust caused by rapid rotation of the abrasive member. The abrasive member can rotate using small force in accordance with direct connection of the abrasive member to the motor. Even when the abrasive member rotates at high speed, scattering of water or dust is prevented in accordance with direct connection of the abrasive member to the motor. Accordingly, the abrasive member can be driven using a battery of a small vehicle.

3 Claims, 4 Drawing Sheets

(56) References Cited

U.S. PATENT DOCUMENTS

| | | | | | |
|---|---|---|---|---|---|
| 2,648,174 | A | * | 8/1953 | Bikles | 451/194 |
| 3,733,751 | A | * | 5/1973 | Williams | 451/45 |
| 3,827,185 | A | * | 8/1974 | Smith | 451/72 |
| 3,879,896 | A | * | 4/1975 | Maxfield et al. | 451/65 |
| 4,322,915 | A | * | 4/1982 | Kindig | 451/65 |
| 4,779,603 | A | * | 10/1988 | Crocetti | 125/13.01 |
| 5,218,787 | A | * | 6/1993 | Rice | 451/229 |
| 5,688,161 | A | * | 11/1997 | Gregory et al. | 451/45 |
| 5,941,763 | A | * | 8/1999 | Kaye | 451/278 |
| 6,676,495 | B1 | * | 1/2004 | Siemers et al. | 451/278 |
| 6,796,890 | B1 | * | 9/2004 | Goldrick | 451/454 |
| 7,220,170 | B2 | * | 5/2007 | Boccia | 451/45 |
| 2004/0128812 | A1 | * | 7/2004 | Beattie | 29/10 |
| 2005/0090184 | A1 | * | 4/2005 | Zhang et al. | 451/5 |
| 2007/0218819 | A1 | * | 9/2007 | Schwaiger et al. | 451/371 |

FOREIGN PATENT DOCUMENTS

| | | |
|---|---|---|
| KR | 10-0897765 | 5/2009 |
| KR | 10-2011-0008415 | 1/2011 |

* cited by examiner

KNIFE SHARPENING SYSTEM

CROSS REFERENCE TO RELATED APPLICATIONS

This application is a continuation of International Application No. PCT/KR2011/006379, filed on Aug. 30, 2011, entitled "BLADE GRINDING SYSTEM," which claims priority under 35 U.S.C. §119 to Application No. KR 10-2011-0041908 filed on May 3, 2011, entitled "BLADE GRINDING SYSTEM," the entire contents of which are hereby incorporated by reference.

FIELD OF THE INVENTION

The present invention relates to a knife sharpening system, and more particularly to a knife sharpening system mountable in a small vehicle to enable easy calling on knife owners in homes or restaurants who desire sharpening of their knives, in order to sharpen the knives.

BACKGROUND

In a knife sharpening system in which a grinding member is rotated by a motor, rotation of the grinding member is achieved under the condition that RPM of the motor is reduced. Rotation of a polishing brush is also carried out under the above-mentioned conditions. For this reason, it is necessary to employ a reduction gear in a conventional knife sharpening system. As a result, there is a disadvantage in that relatively high power is required. To this end, such a knife sharpening system should be mounted in factories to which electricity can be supplied. Otherwise, a separate electric generator should be equipped to power the knife sharpening system. In particular, when such a knife sharpening system is mounted in a vehicle, to be movable, the electric generator is essentially necessary. However, such an electric generator not only generates severe noise, but also causes enlargement of the system. Due to the enlarged size of the knife sharpening system, it is difficult to mount the electric generator in a small vehicle.

SUMMARY

Therefore, the present invention has been made in view of the above problems, and it is an object of the present invention to provide a small-size knife sharpening system mountable in a small vehicle, not only to enable easy calling on knife owners in homes or restaurants who desire sharpening of their knives, in order to sharpen the knives, but also to use power from a battery of the vehicle without requiring separate power, while having a configuration capable of reducing the size of the system, and efficiently preventing scattering of cooling water and dust occurring during knife sharpening.

In accordance with an aspect of the present invention, a knife sharpening system operable by a small-size motor operable by a battery of a vehicle is provided. Generally, in a knife sharpening system, which is operable by a battery of a vehicle, it is difficult to use a reduction gear because battery power is relatively weak. To this end, the present invention provides a knife sharpening system in which an abrasive member and a polishing brush are connected to a motor operable by a battery of a vehicle via pulleys directly connected to a shaft of the motor, without using a reduction gear. In such a knife sharpening system, dust may scatter severely during a knife sharpening operation, together with water sprayed onto the abrasive member because the abrasive member or polishing brush rotates at 1,750 revolutions per minute (RPM). In such a negative environment, it is impossible to carry out desired tasks. Furthermore, for convenience, the knife sharpening position, namely, the position at which a knife contacts the abrasive member, should correspond to a lower side of the abrasive member. As a result, scattering dust and water may fly toward the front of the operator. Due to such a problem, in conventional cases, it is impossible to increase the rate of rotation of the abrasive member. In conventional knife sharpening systems, accordingly, a reduction gear is installed to prevent the rate of rotation of the abrasive member from exceeding 200 to 300 RPM. The inventors of the present invention found that it is necessary to provide a knife sharpening system equipped with a dust-proof device preventing water or dust from scattering toward the operator even when the abrasive member or polishing brush rotates at high speed through direct connection thereof to the motor as described above, in order to avoid loss of rotational force of the motor. Thus, the present invention provides a knife sharpening system including a dust-proof device including a cover for shielding upper, lower, left, right, and back sides of an abrasive member, except for a front side of the abrasive member, and a scattering material blocking member for blocking a space between the abrasive member and the operator.

In addition, the present invention provides a knife sharpening system including an upper cover for an abrasive member, which covers an upper side of a polishing brush in addition to the abrasive member, and a collection box installed in a direction tangential to a polishing point of the polishing brush, to reduce a dust flow path, for prevention of flow of dust around an inside of the upper cover.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Hereinafter, embodiments of the present invention will be described in detail with reference to the accompanying drawing.

Figure 1:
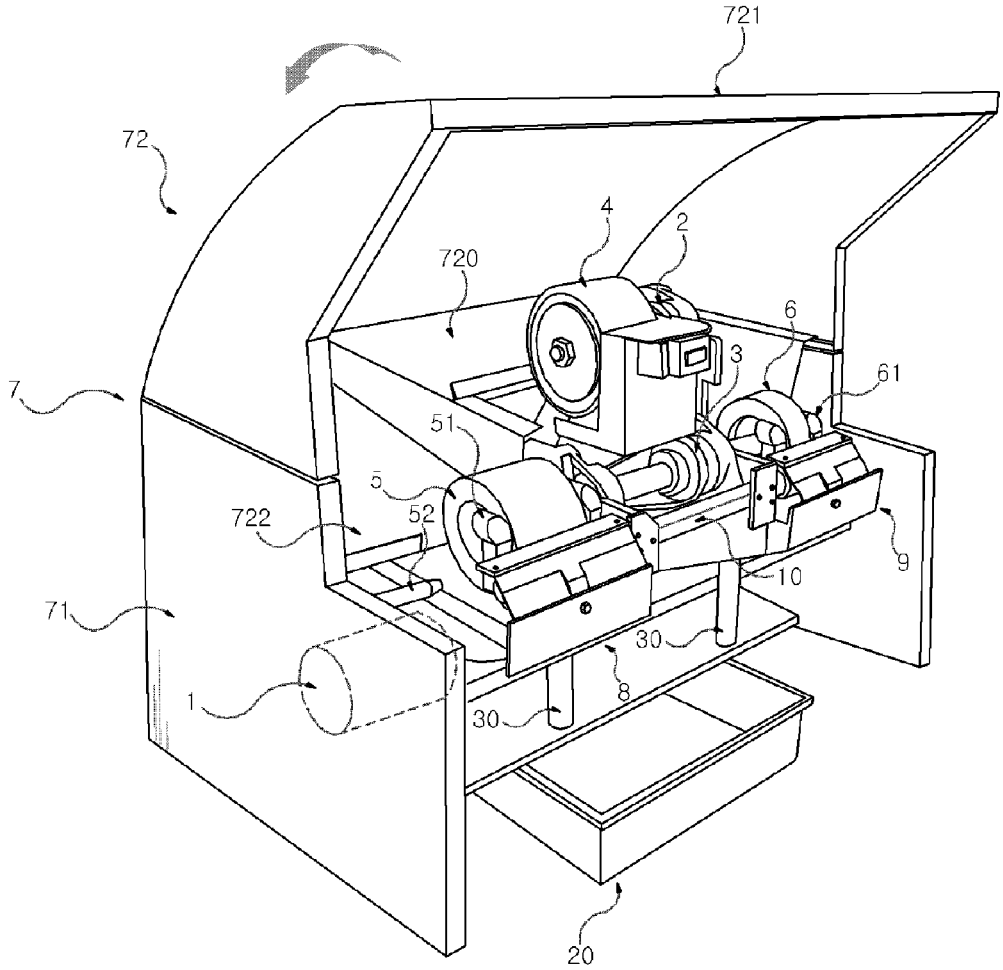
FIG. 1 is a perspective view illustrating a knife sharpening system according to an embodiment of the present invention.

Referring to FIG. 1, a knife sharpening system according to an embodiment of the present invention is illustrated. The illustrated knife sharpening system includes a grinding device, and a dust-proof device for preventing scattering of dust produced in the grinding device.

The grinding device includes a motor 1 to be driven by a battery of a vehicle, two pulleys 2 and 3 connected to the motor 1, a polishing brush 4 mounted to a shaft of one of the pulleys 2 and 3, for example, the pulley 2, and cylindrical abrasive members 5 and 6 mounted to a shaft of the other of the pulleys 2 and 3, for example, the pulley 3, while being disposed below the polishing brush 4 at opposite sides of the polishing brush 4. The grinding device further includes a support bar 10 disposed below the cylindrical abrasive members 5 and 6 in parallel with the shaft of the pulley 3, knife support members 51 and 61 mounted on the support bar 10, and water injection nozzles 52 disposed to inject water toward the abrasive members 5 and 6, respectively.

The dust-proof device includes a cover 7 for shielding upper, lower, left and right sides of the abrasive members 5 and 6 and polishing brush 4, except for front sides of the abrasive members 5 and 6 and polishing brush 4, and scattering material blocking units 8 and 9 for blocking a space between each of the abrasive member 5 and 6 and the operator.

Figure 2:
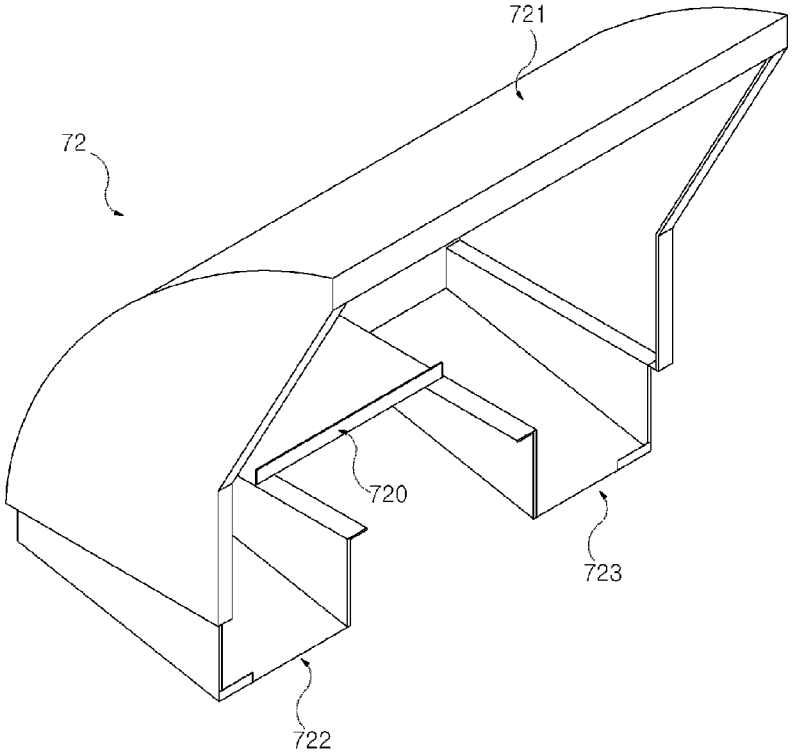
FIG. 2 is a view illustrating a cover member according to an embodiment of the present invention.

The cover 7 includes a lower cover member 71, and an upper cover member 72 pivotally mounted to a rear top portion of the lower cover member 71 by hinges. As illustrated in FIG. 2, the upper cover member 72 includes an upper cover portion 721, and a bottom plate 720. The bottom plate 720 includes guide portions 722 and 723 mounted to a lower end of the upper cover portion 721 at opposite sides of the upper cover portion 721, respectively, to guide discharge of scattering materials including metal powder. Dust collected in the guide portions 722 and 723 is collected into a collection box 20 via a dust discharge tube 30, together with water injected from the water injection nozzles 52.

Figure 5:
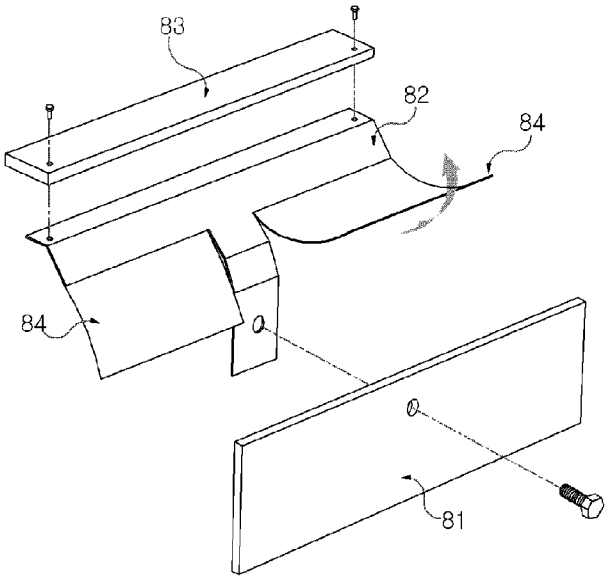
FIG. 5 is an exploded view illustrating the scattering material blocking unit.
Figure 6:
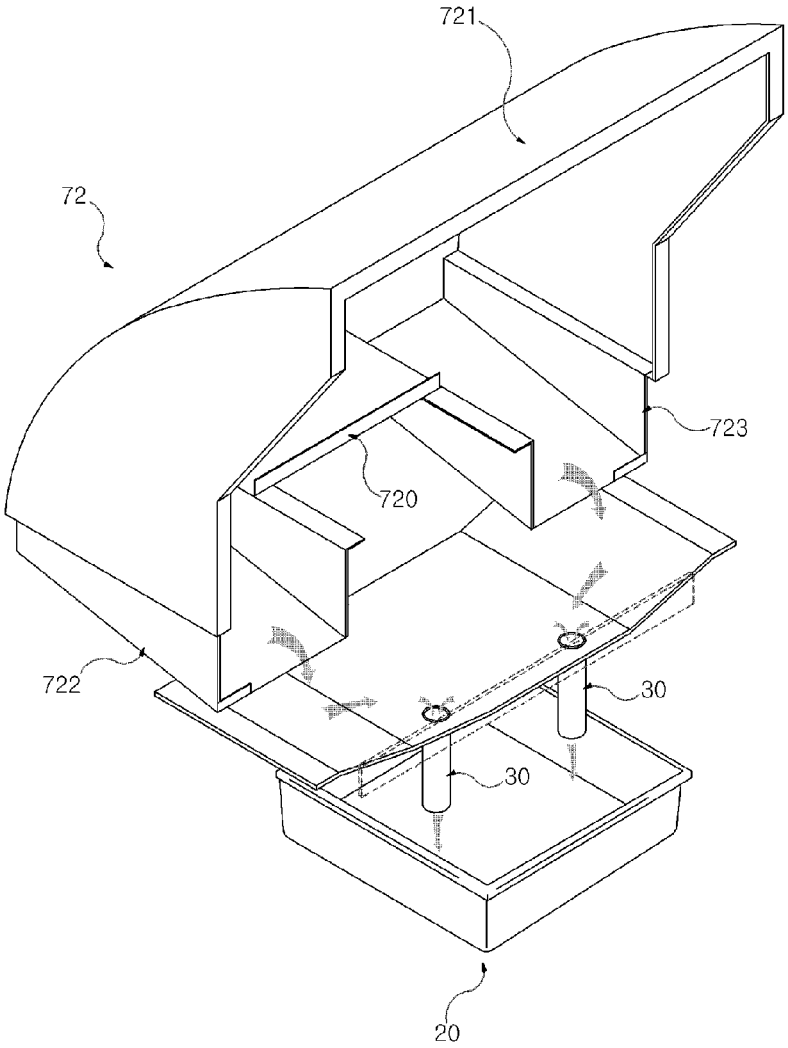
FIG. 6 is a view illustrating a procedure of discharge of scattering materials.

The scattering material blocking units 8 and 9 are mounted to the support bar 10 beneath the abrasive members 5 and 6, respectively. As illustrated in FIG. 5, the scattering material blocking unit 8 may include a front plate 81 mounted to a base of the system, a T-shaped blocking plate 82 mounted to an upper portion of the front plate 81, a damper 83 mounted to an upper end of the T-shaped blocking plate 82, and cover plates 84 for covering opposite opened side spaces of the T-shaped blocking plate 82, respectively. Since the scattering material blocking unit 9 has the same structure as the scattering material blocking unit 8, no detailed description thereof will be given.

Figure 3:
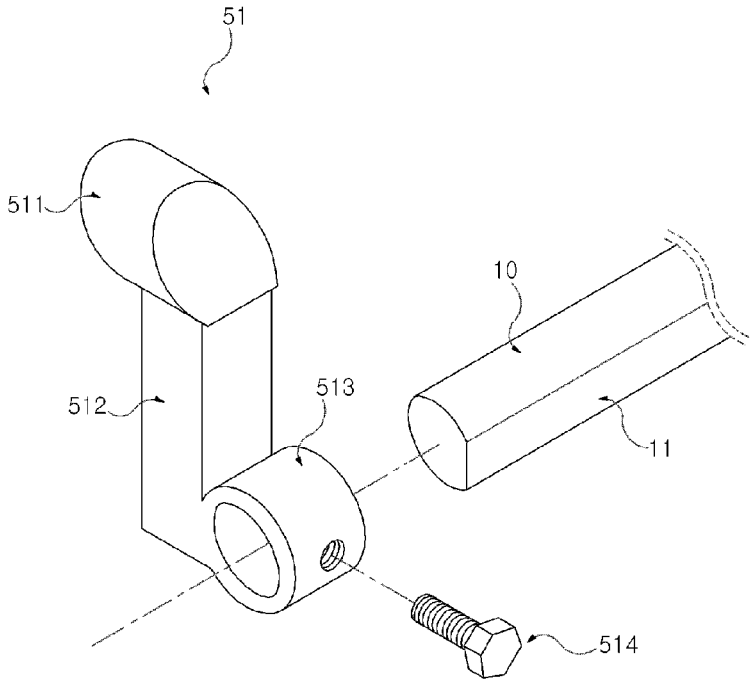
FIG. 3 is a view illustrating coupling of a knife support member to a support bar.
Figure 4:
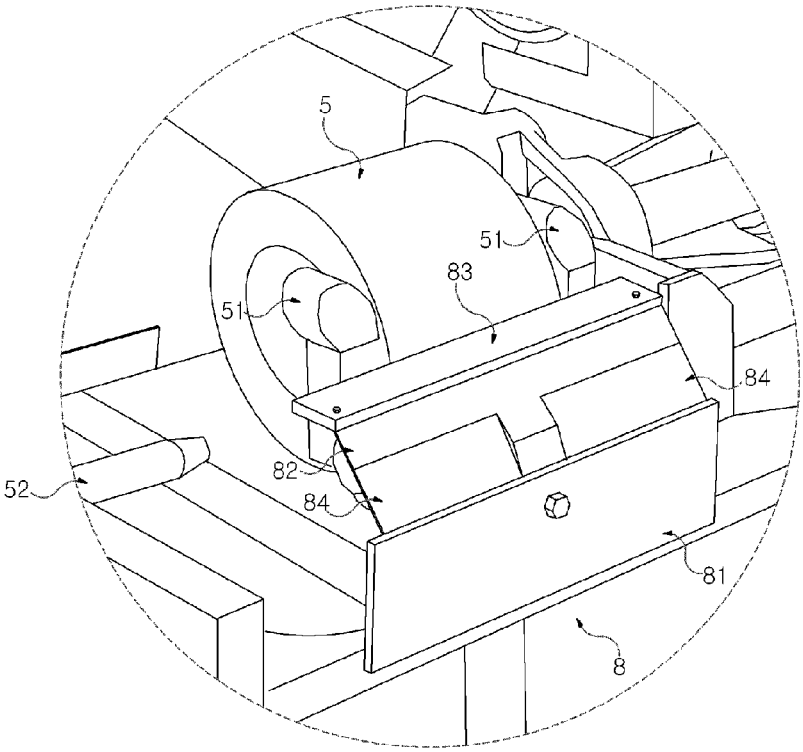
FIG. 4 is a view illustrating installation of a scattering material blocking unit.

Two knife support members 51 are disposed at opposite sides of the abrasive member 5, respectively. Similarly, two knife support members 61 are disposed at opposite sides of the abrasive member 5, respectively. As illustrated in FIG. 3, each knife support member 51 includes a body 512, a round portion 511 formed at an upper end of the body 512, and a fitting portion 513 formed at a lower end of the body 512 while being formed with a fitting hole. The knife support member 51 is fitted around the support bar 10 fixed to the system through the fitting hole of the fitting portion 513. Since the knife support members 61 have the same structure as the knife support members 51, no detailed description thereof will be given. The support bar 10 has a flat portion 11 and, as such, the knife support members 51 and 61 are fastened to the support bar 10 by fastening screws 514.

The round portion 511 functions to adjust the contact angle of a knife contacting the abrasive member 5. Since the knife support members 51 and 61 are fastened to the support bar 10 by the fastening screws 514, it is possible to freely adjust the mounting positions of the knife support members 51 and 61 while sliding the knife support members 51 and 61 along the support bar 10 in accordance with the widths of the abrasive members 5 and 6. The flat portion 11 of the support bar 10 prevents the knife support members 51 and 61 from rotating unintentionally. In accordance with the above-described configuration, the knife support members 51 and 61 may be accurately position-adjusted to be positioned adjacent to the abrasive members 5 and 6. Thus, abrasive members having various sizes are applicable to the knife sharpening system of the present invention.

Since fastening of the knife support members 51 and 61 to the support bar 10 is achieved, using the fastening screws 514, it is necessary to remove the scattering material blocking units 8 and 9 upon fastening or unfastening the fastening screws 514. However, this removal is difficult. To this end, the T-shaped blocking plate 82, which is formed with open spaces at opposite sides thereof, is preferably mounted to each of the scattering material blocking units 8 and 9, to secure a working space allowing fastening or unfastening of the fastening screws 514 while covering the open spaces by the cover plates 84, to block scattering materials. Each cover plate 84 may be made of a flexible synthetic resin material, to be connected, at an upper end thereof, to the associated T-shaped blocking plate 82 while being engaged, at a lower end thereof, with an upper portion of the front plate 81. That is, as illustrated in FIG. 5, the cover plate 84, which is engaged with the upper portion of the front plate 81, may be lifted to be separated from the front plate 81 and, as such, the space covered by the cover plate 84 is opened, to provide a working space. In this state, accordingly, it is possible to easily carry out fastening or unfastening of the fastening screws 514.

The damper 83 is provided to prevent a sharpened blade of the knife from being damaged due to striking thereof occurring when the knife is removed after being ground by the abrasive member between the knife support members 51 or 61. Accordingly, the damper 83 is preferably made of a material having low hardness, for example, synthetic resin.

That is, in accordance with the present invention, when a switch operates under the condition that a knife contacts the abrasive member 5 or 6 between the knife support members 51 or 61, the motor 1 is driven by power supplied from the battery of the vehicle. Accordingly, the motor 1 rotates the abrasive member 5 or 6 via the pulleys 2 and 3, thereby grinding the knife. At this time, the water injection nozzle 52 injects water, not only to reduce production of dust, but also to cool the knife, for hardening of the knife.

As described above, dust or the like produced during grinding is blocked by the cover 7 and scattering material blocking units 8 or 9, and is then collected. The collected dust is then fed to the dust collection box 20 via the dust discharge tube 30.

Meanwhile, the polishing brush 4 is used to finish the sharpened knife.

As apparent from the above description, the present invention provides effects of utilizing power from a battery of a small vehicle as drive power because high power is not required. That is, rotational force from a motor operating by power from the battery of the vehicle is transmitted to the abrasive member or polishing brush without being attenuated and, as such, it is possible to sharpen a knife using the rapidly rotating abrasive member or polishing brush. Although the knife is sharpened by the rapidly rotating abrasive member or polishing brush, there is no deterioration of the working environment due to scattering of water or dust in accordance with the present invention. Thus, effective knife sharpening is possible through operation of an abrasive member or polishing brush by a small-size motor operable by a battery of a vehicle. Furthermore, it is possible to greatly reduce knife sharpening time because the abrasive member or polishing brush rotates at high speed and, as such, an enhancement in workability is achieved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A knife sharpening system comprising:

a grinding device comprising:

a motor configured to be driven by a battery of a vehicle;

first and second pulleys directly connected to the motor;

a polishing brush directly connected to the first pulley and disposed at a central upper region of the system;

cylindrical abrasive members directly connected to the second pulley and disposed below the polishing brush at opposite sides of the polishing brush, each cylindrical abrasive member having an abrasive surface on its elongated cylindrical surface in parallel to a shaft of the second pulley;

a support bar disposed below the cylindrical abrasive members in parallel with an axis of the second pulley;

knife support members mounted on the support bar; and water injection nozzles disposed to inject water toward the cylindrical abrasive members, respectively; and a dust-proof device configured to prevent scattering of dust produced in the grinding device, the dust-proof device comprising:

a cover for shielding upper, lower, left and right sides of the cylindrical abrasive members and upper, lower, left and right sides of the polishing brush, except for front sides of the cylindrical abrasive members and a front side of the polishing brush; and scattering material blocking units mounted to the support bar beneath the abrasive members, respectively, the scattering material blocking units being elongated in a direction in parallel to cylindrical surfaces of the abrasive members and longer than the abrasive members to cover full lengths of the abrasive members;

wherein: the cover comprises a lower cover member and an upper cover member pivotally mounted to a rear top portion of the lower cover member by a hinge; and the upper cover member comprises an upper cover portion and a bottom plate, the bottom plate comprising guide portions mounted to a lower end of the upper cover portion at opposite sides of the upper cover portion, respectively, each guide portion shaped like a channel that has a down-sloped bottom from back to front to guide discharge of materials scattering from the cylindrical abrasive members.

2. The knife sharpening system according to claim 1, wherein:

each of the knife support members comprises a body, a round portion disposed at an upper end of the body, and a fitting portion disposed at a lower end of the body and having a fitting hole to enable the knife support member to be fitted around the support bar through the fitting hole of the fitting portion;

the support bar comprises a flat portion; and the knife support members are fastened to the support bar by fastening screws.

3. The knife sharpening system according to claim 1, wherein each of the scattering material blocking units comprises a front plate mounted to a base of the knife sharpening system, a T-shaped blocking plate mounted to an upper portion of the front plate, and cover plates configured to cover opposite opened side spaces of the T-shaped blocking plate, respectively.

* * * * *